US007210380B1

(12) United States Patent
Wu

(10) Patent No.: US 7,210,380 B1
(45) Date of Patent: May 1, 2007

(54) RATCHET TOOL

(76) Inventor: Arthur Wu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/267,601

(22) Filed: Nov. 7, 2005

(51) Int. Cl.
*B25B 13/46* (2006.01)

(52) U.S. Cl. ..... 81/63.2; 81/63.1

(58) Field of Classification Search ..... 81/62, 81/63, 63.1, 63.2; 192/43.2
See application file for complete search history.

(56) References Cited

U.S. PATENT DOCUMENTS 6,386,072 B1 * 5/2002 Yuan-Chin et al. ..... 81/63.2
6,907,804 B2 * 6/2005 Shu-Ying et al. ..... 81/63.2
6,955,104 B2 * 10/2005 Hu ..... 81/63.2
2004/0237727 A1 * 12/2004 Huang ..... 81/62
2005/0092135 A1 * 5/2005 Chen ..... 81/63.1
2005/0092136 A1 * 5/2005 Chen ..... 81/63.1
2005/0257651 A1 * 11/2005 Chen ..... 81/63.2
2006/0117913 A1 * 6/2006 Chen ..... 81/63.1

* cited by examiner

*Primary Examiner*—D. S. Meislin

(57) ABSTRACT

A ratchet tool uses a braking piece disposed in a receptacle area in the box head of a wrench for locking the ratchet wheel. The braking piece has two opposite components respectively extended from the top ends thereon and is coupled to a pushing mechanism consisting of a first and a second resilient parts. The resilient parts are attached on two lateral sides of a connecting piece, whereby the braking piece urged by a multi-step repositioning spring force in a process of backward reposition will produce louder noises for a better recognition of a user. The receptacle areas can be easily sealed by a cover plate for a fast assembly.

4 Claims, 6 Drawing Sheets

RATCHET TOOL

FIELD OF THE INVENTION

The present invention relates to ratchet tools, more particularly to a ratchet tool that is easy to assemble and can produce louder noises for a better recognition of a user.

BACKGROUND OF THE INVENTION

A ratchet tool of the prior art, as disclosed by U.S. Pat. No. 6,386,072, uses a switch to drive the left and right shift of a driving piece, which in turn drives a resilient pushing device to push a braking piece to engage another driving piece, whereby the wrench box can attain a forward and backward rotation. Further, a longitudinal supporting device within the wrench main body can be engaged with a locking portion of the driving piece to achieve a retaining effect of a ratchet wheel.

However, the ratchet wrench of the prior art lacks a basic function of producing noises in backward reposition for facilitating operation in the night time when visual recognition is not allowed.

In a conventional ratchet wrench, the braking piece is driven by the pushing unit disposed in the half-moon shaped rear portion of the retaining box of a ratchet wrench, which pushing unit consists of a resilient piece and a pushing piece and provide the reposition of the braking piece with a necessary force. Thereby, the driving part and the switch unit can be engaged, and, since a locking portion of the switch unit restricts the motion of the switch unit, the driving part of the wrench is accordingly locked, leading to a small spacing between a projected portion and a groove of the driving part for the braking piece to move. Therefore, the noises produced in a process of backward reposition are not loud enough for people operating it at night time hard to recognize such a reposition.

Further, a ratchet wrench of the prior art has a complex assembly process that includes a step of locking a buckle body within boundary groove around a cover, in addition to an orderly placement of the driving part and the braking body.

SUMMARY OF THE INVENTION

The primary objective of the present invention is to provide a ratchet tool wherein a braking piece urged by a multi-step repositioning spring force in a process of backward reposition will produce louder noises for a better recognition of a user.

The secondary objective of the present invention is to provide a ratchet tool capable of being easily sealed by a cover plate and assembled fast.

To achieve above object, present invention provides a ratchet tool. The ratchet tool comprises a wrench handle forming at least a box head at one end thereof, said box head having a first and a second receptacle areas which are connected, said first receptacle area being provided with a flange and an annular groove; a ratchet wheel engaged with said an annular groove of said box head and rotationally confined in said first receptacle area; a cover plate connecting said wrench handle and said ratchet wheel, one side of said cover plate being provided with a through hole for passing said ratchet wheel, another side of said cover plate being provided with an arched hole corresponding to said second receptacle area; a braking piece having a front arched surface provided with a teeth portion corresponding to said outer ratchet teeth of said ratchet wheel and a rear surface provided with a pair of lateral contact faces supported against said second receptacle area, a top surface of said braking piece further including a pair of blocking parts for facilitating changing directions of said braking piece, the motion of said braking piece being restricted in said arched through hole of said cover plate, a front surface of said braking piece being provided with a teeth portion capable of being engaged with outer ratchet teeth around said ratchet wheel by a first pushing unit; a connecting piece disposed beneath said cover plate having a blocking piece extended from a top surface thereof, said blocking piece being connected to said connecting piece through a flexible unit; and a switch piece locked with said connecting piece and being capable of being switched in a direction selected from left and right directions.

The various objects and advantages of the present invention will be more readily understood from the following detailed description when read in conjunction with the appended drawings.

BRIEF DESCRIPTION OF THE DRAWINGS

FIG. 1A is a local cross-sectional view of the ratchet tool in FIG. 1.

FIG. 1B shows the bottom end of the ratchet wheel of the ratchet tool in FIG. 1.

DETAILED DESCRIPTION OF THE PREFERRED EMBODIMENTS

Figure 1:
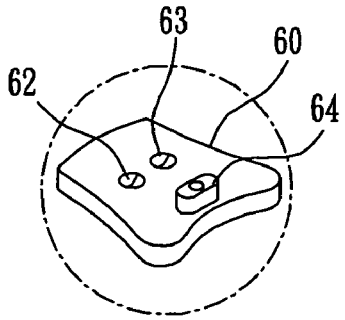
FIG. 1 is an exploded perspective view of a ratchet tool of the present invention.
Figure 1:
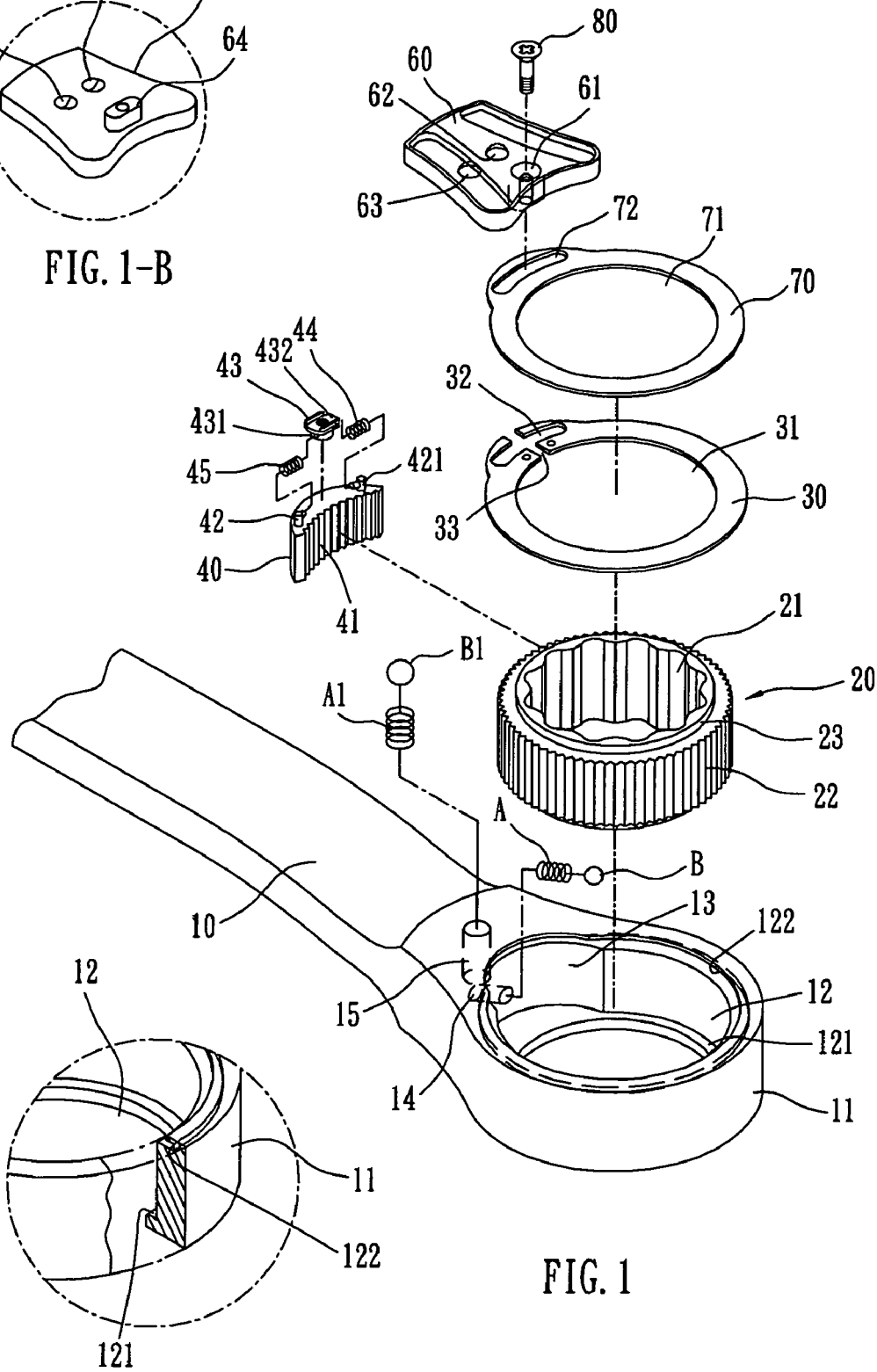
Figure 4:
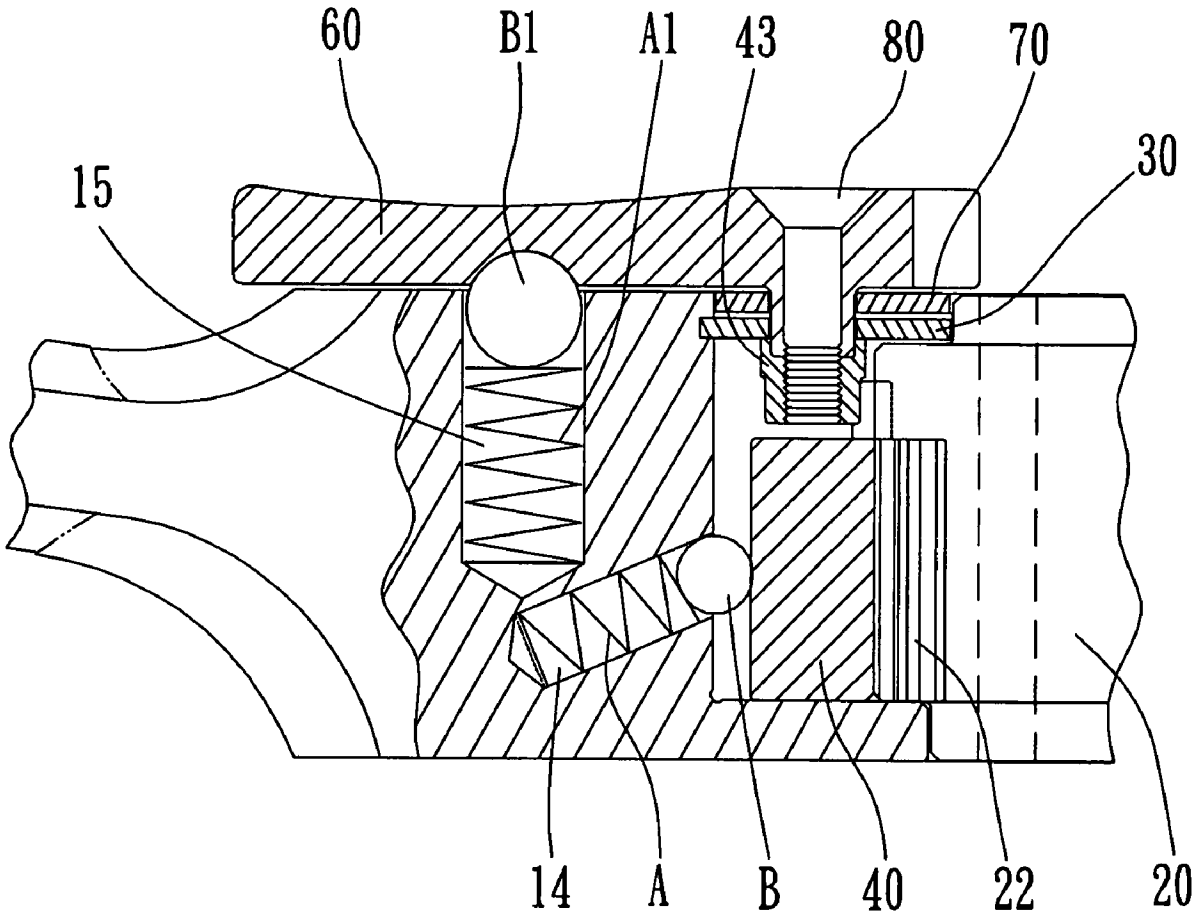
FIG. 4 is a local cross-sectional view of the box head of the ratchet tool in FIG. 1.

Referring to FIGS. 1, 1A and 4, a ratchet tool according to the present invention comprises a bench handle 10, a ratchet wheel 20, a cover plate 30, a braking piece 40, a T shaped connecting piece and a switch piece 60.

The wrench handle 10 is basically a handle with at least one closed box head 11 at one end thereof. The box head 11 has a round first receptacle area 12 whose axis extends along the axial direction of the box head 11. One lateral side of the first receptacle area 12 forms a half-moon shaped second receptacle area 13. The lower rim of the first receptacle area 12 is provided with a flange 121, and the upper rim of the first receptacle area 12 is provided with an annular groove 122.

The ratchet wheel 20, retained in a rotatable fashion in the first receptacle area 12, has a polygonal inner wall 21 and an outer wall on which a multitude of ratchet teeth 22 are uniformly arranged. The inner wall 21 and the outer wall 22 is separated by a flange wall 23.

The cover plate 30 is retained on the ratchet wheel 20 by the engagement between the flange wall 23 and a through hole 31 thereon. The cover plate 30 is further coupled to the annular groove 122 around the first receptacle area 12, as so to prevent the cover plate 30 from a departure from the first receptacle area 12. On later side of the cover plate 30 is extended with a half-moon shaped projected area that corresponds to the second receptacle area 13. The projected area is further provided with an arched hole 32 and a connected slot 33, whereby the cover plate 30 can resiliently contract inward and can coupled to the annular groove 122 around the first receptacle area 12.

The braking piece 40, being an arched piece within the second receptacle area 13, has a front arched surface provided with a plurality of teeth 41 corresponding to the outer ratchet teeth 22 around the ratchet wheel 20 and a rear arched surface that can be pushed by a spring A and a support steel ball B, whereby the front teeth 41 of the braking piece 40 can urged to engage the ratchet teeth 22 around the ratchet wheel 20. The spring A and the support steel ball B form a first push mechanism and are disposed in a through hole 14 on the second receptacle area 13. The lateral sides of the rear arched surface of the braking piece 40 respectively form support faces for engaging the inner wall of the second receptacle area 13. Further, near the lateral sides of the braking piece 40, there are vertically extended symmetrical retaining parts 42, which retaining parts 42 are respectively further extended with horizontal extended rods 421.

Figure 8:
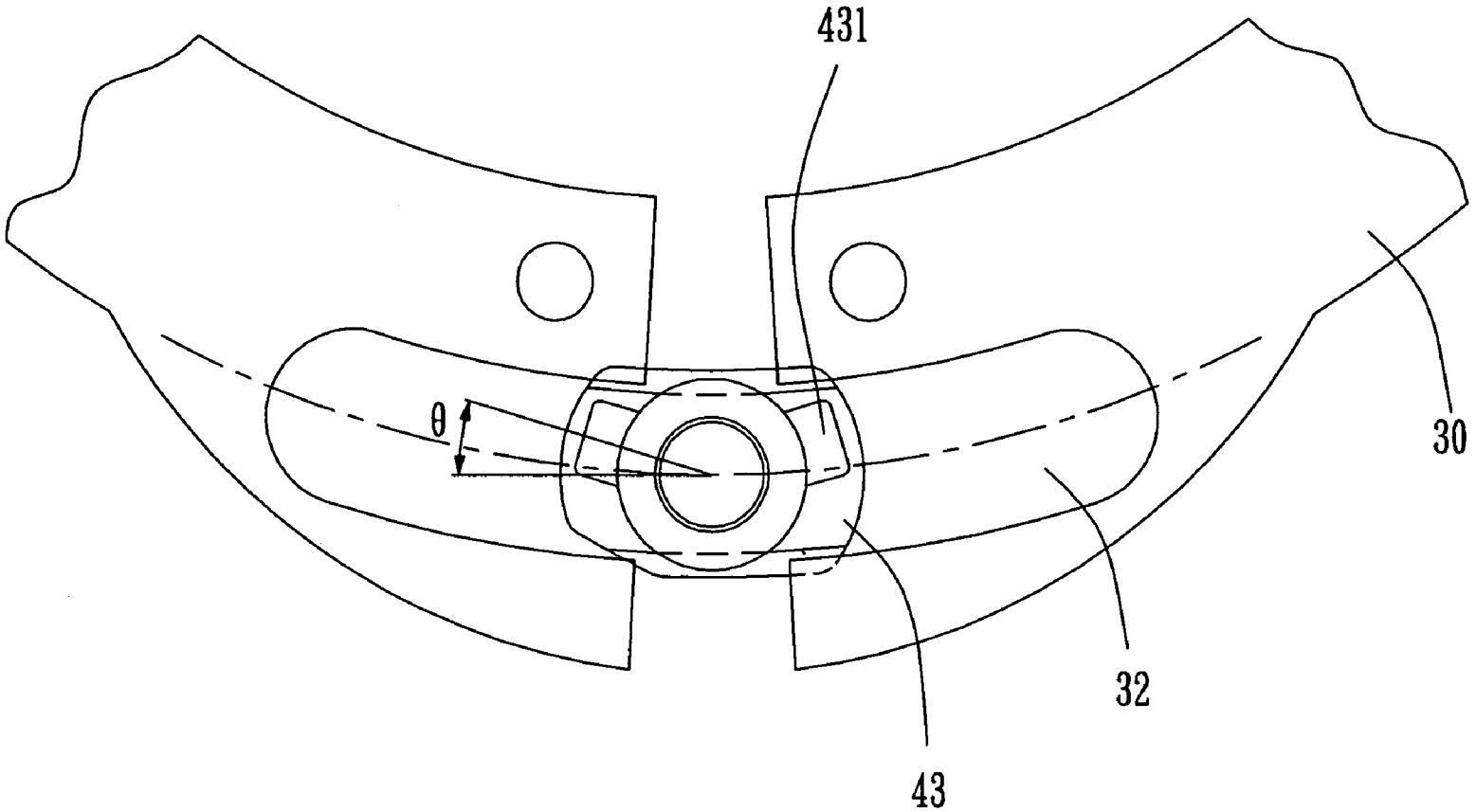
FIG. 8 illustrates the angle between the connecting piece and the horizontal connecting beam of the ratchet tool in FIG. 1.

The connecting piece 43 is a T shape block. Each of two sides of a bottom thereof is extended with a horizontal beam 431. A spring 44 is connected between one horizontal extending rod 421 and one retaining part 42. Another spring 45 is connecting between the other horizontal extending rod 421 and the other retaining part 42. Thereby, the connecting piece 43 is exactly received on the two symmetrical retaining parts 42. Referring to FIG. 8, it is preferable that the angle θ between the horizontal beam 431 and the connecting piece is between 5°~30°. In this range, the springs 44, 45 will have preferred elasticity and flexibility between the retaining parts 42 and the horizontal beams 431.

The switch piece 60 is connected to the connecting piece 43 by inserting a screw 80 into a front screw hole 61. The arched column 64 on a bottom surface of the switch piece 60 is slightly small than the width of the arched hole 32 on the cover plate 30, as shown in FIG. 1B. Further, the arched column 64 is engaged with an arched groove 432 on the top surface of the connecting piece 43. Thereby, an angular shift when the screw 80 is tightened can be avoided, and the switch piece 60 will be capable of being slid in the left and right directions in the top portion of the wrench handle 10. The bottom surface of the switch piece 60 are provided with a first retaining hole 62 and a second retaining hole 63 for retaining a second pushing unit housed within a retaining hole 16 of the wrench handle 10 and consisting of a spring A1 and a steel ball B1, whereby the switching of the switch piece 60 will be properly positioned.

Further, the ratchet tool of the present invention can be provided with a decorative plate 70 over the cover plate 30, the braking piece 40 and the switch 60. The decorative plate 70, similar in geometry to the cover plate 30, has a through hole 71 connected with an arched projected portion, wherein an arched hole 72 corresponding to the arched hole 32 is formed. The decorative plate 70 is for an ornamental and anti-dust purpose.

Figure 2:
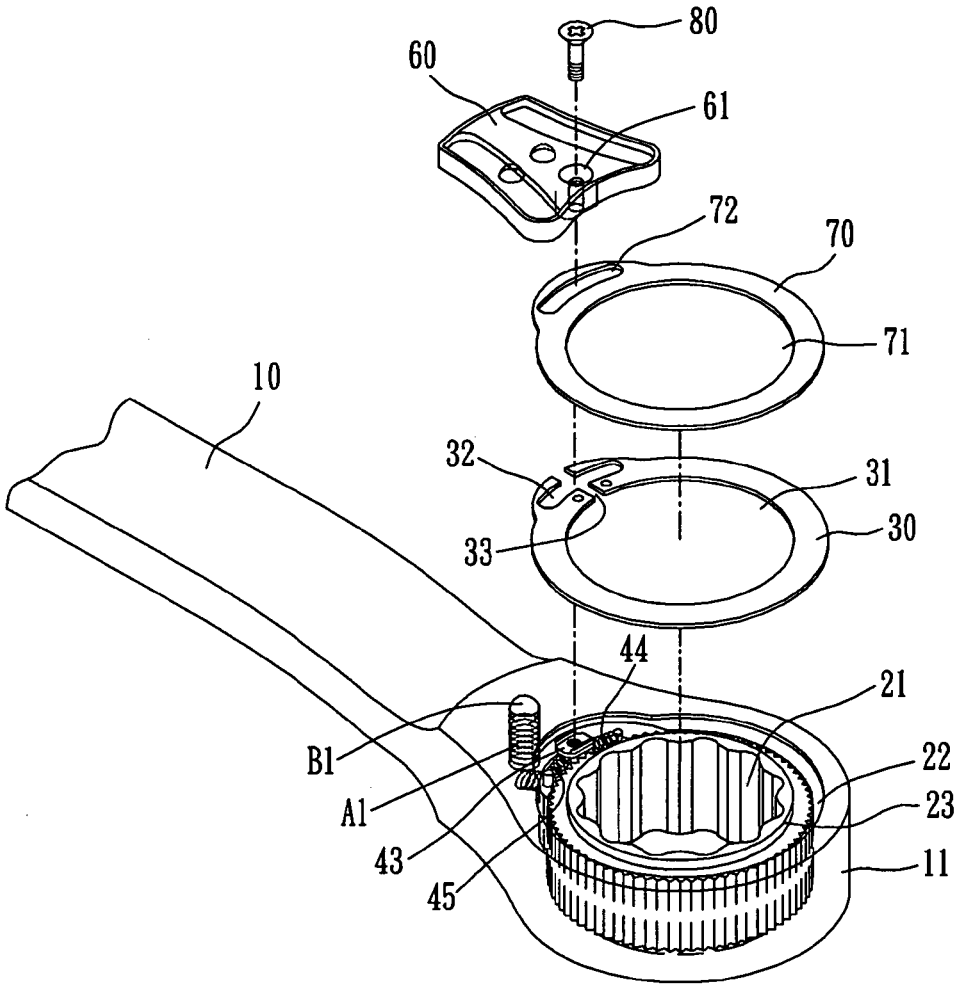
FIG. 2 show the assembly of the ratchet wheel of the ratchet tool in FIG. 1.
Figure 3:
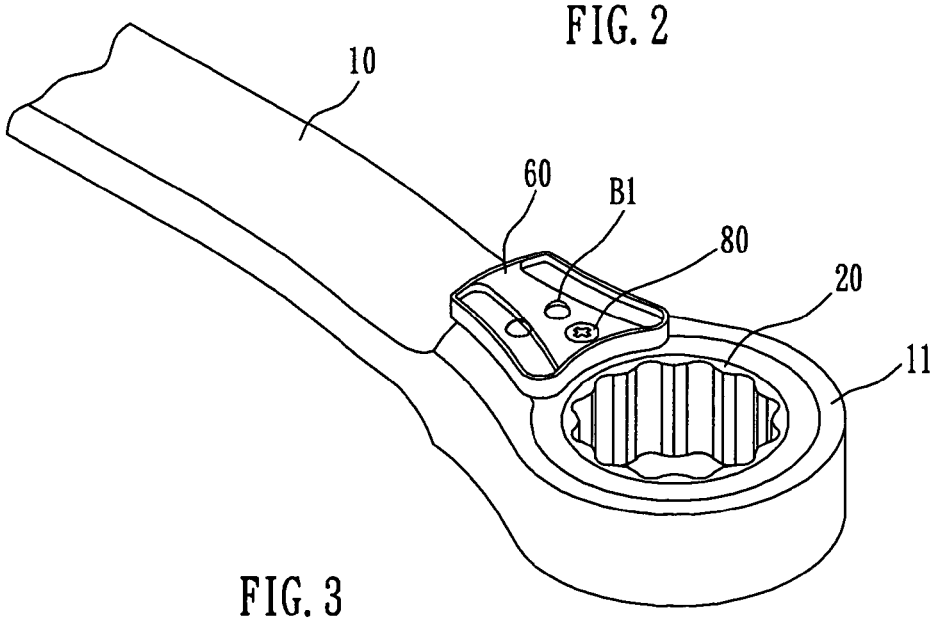
FIG. 3 is a local perspective view of the ratchet tool in FIG. 1, after the assembly.

Referring to FIGS. 2 and 3, the assembly of a ratchet tool of the present invention is superior to the conventional ratchet tool. To assemble a ratchet tool of the present invention, the braking piece 40 and the connecting piece 43 are combined through the first and second resilient parts 44, 45. Secondly, the spring A and the steel ball B of the first pushing unit are placed into the through hole 14; then the combined component of the braking piece 40 and the connecting piece 43 is placed in the second receptacle area 13, the steel ball B being pushed simultaneously. The ratchet wheel 20 is then placed in the first receptacle area 12, and the cover plate 30 is coupled with the annular groove 122 of the first receptacle area 12. At this time, the two symmetrical blocking pieces 42 on the top surface of the braking piece 40 and the connecting piece 43 are disposed in the arched hole 32. The first and second receptacle areas 12, 13 are enclosed, preventing the departure of a ratchet wheel 20 and the braking piece 40 from the box head 11 of the wrench handle 10. Eventually, the decorative plate 70 is attached onto the cover plate 30 and fixed thereon by the screw 80 that goes through the front screw hole 61 on the of the switch piece 60, the arched hole 72 on the decorative plate 70, the arched hole 32 on the cover plate 30 and the hole with a screw thread extended in an axial direction within the connecting piece 43. Further, the arched projected column 64 will be engaged within the top arched groove 432, whereby an angular shift of the screw 80 as it is tightened can be avoided. Thereby, the smooth slide of the column 64 along the arched hole 32 can be guaranteed.

Figure 5:
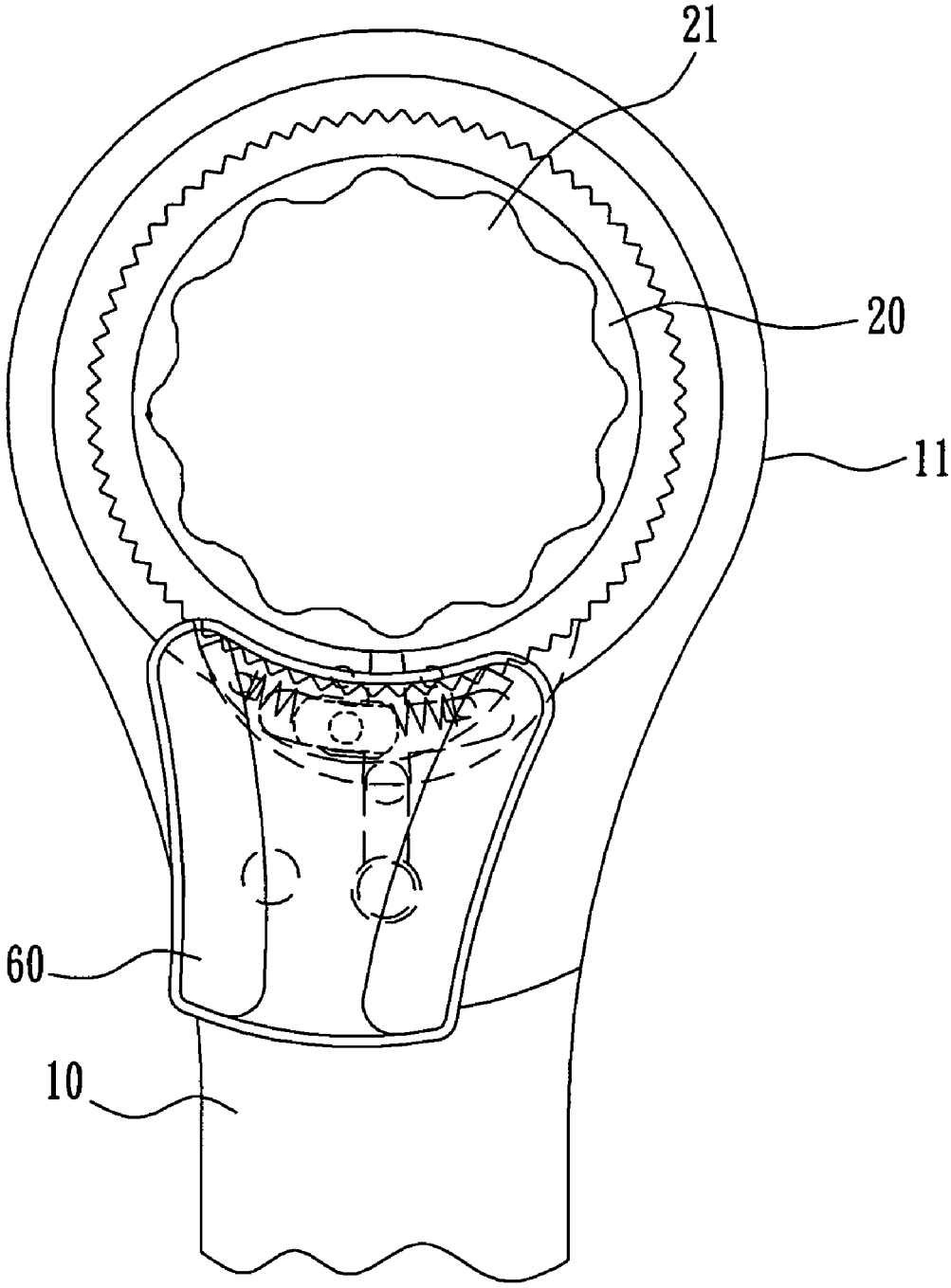
FIG. 5 is a local perspective view of the ratchet tool in FIG. 1 wherein the switch is pointed to a clockwise direction.
Figure 7:
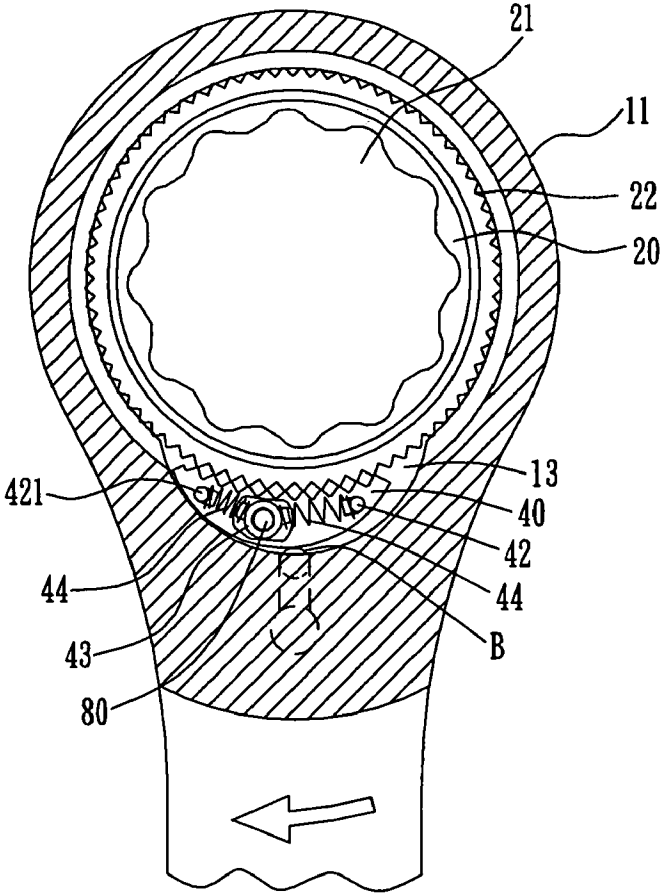
FIG. 7 is a local cross-sectional view showing the braking piece being pushed by the ratchet wheel in a process backward reposition.
Figure 6:
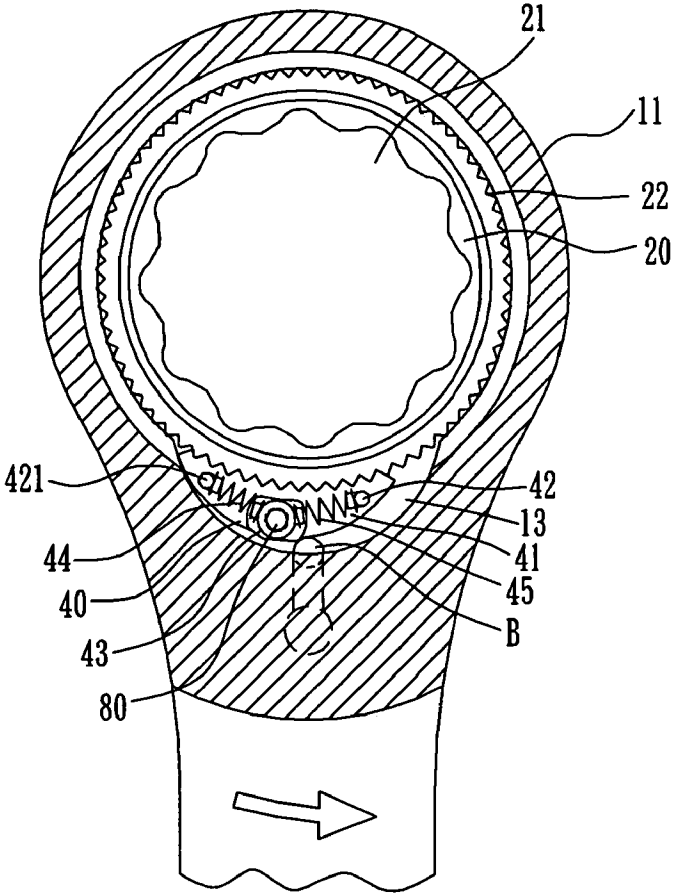
FIG. 6 is a local cross-sectional view of the braking piece of the ratchet tool in FIG. 1 when the wrench handle is twisted in a counterclockwise direction and it is tilted against a receptacle area.

Referring to FIGS. 5, 6 and 7, the primary objective of the present invention is to produce louder noises when the ratchet wrench is undergoing a backward reposition for better recognition by the user.

Referring to FIG. 5, when the switch piece 60 is switched in the clockwise direction, the braking piece in the second receptacle area 13 will be tilted against the left wall of the receptacle area 13. As shown in FIG. 6, the connecting piece 43 pivotally connected with the switch piece 60 will move to the left slightly. Since the blocking pieces 42 on the top surface of the braking piece 40 are provided with a first and a second resilient parts 44, 45, the first resilient part 44 will move to the left wall of the second receptacle area 13 and contract, whereas the second resilient part 45 will stretch, whereby by the braking piece 40 will be pushed by first pushing unit in the through hole 14 in the rear portion of the second receptacle area 13. Thereby, the teeth portion 41 of the braking piece 40 will be engaged with the outer ratchet teeth 22 around the ratchet wheel 20. Being pushed from three directions, the let side of the braking piece 40 tilts against the left inner wall of the second receptacle area 13, whereby the ratchet wheel 20 will be driven in the counterclockwise direction.

Referring to FIG. 6, when the wrench handle 10 is twist in a counterclockwise direction to drive a bolt or a nut over a certain angle and encounters obstacle, a backward (in a clockwise direction) reposition is necessary, as shown in FIG. 7. Since the force for this clockwise reposition is larger than the pushing force exerted by the first pushing device, the first and the second resilient pieces, the braking piece 40 coupled with the ratchet wheel 20 will move toward the right side of the second receptacle area 13 and the second receptacle area 13 will contract accordingly, whereby the teeth portion 41 of the braking piece 40 will move over the ratchet teeth 22 of the ratchet wheel 20, and then the restoring force of the first pushing device, the first and the second resilient pieces will draw the braking piece 40 back to its original configuration. Such a process can go continuously to achieve an effect of backward reposition of the wrench handle 10.

In addition to the force of the first pushing device, the braking piece 40 of the present invention is exerted by the restoring forces of the first and the second resilient pieces disposed between the retaining parts 42 and the connecting piece 43 formed on the top surface of the braking piece 40. Thereby, as the ratchet wheel 20 is rotating backward, the three forces mentioned above will produce loud enough noises to remind a user of the action of backward reposition.

To sum up, a ratchet tool of the present invention has the advantages of:

1. structural simplicity for easy assembly; and
2. producing louder noises for reminding backward reposition.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A ratchet tool, comprising:

a wrench handle forming at least a box head at one end thereof, said box head having a first and a second receptacle areas which are connected, said first receptacle area being provided with a flange and an annular groove;

a ratchet wheel engaged with said an annular groove of said box head and rotationally confined in said first receptacle area;

a cover plate connecting said wrench handle and said ratchet wheel, one side of said cover plate being provided with a through hole for passing said ratchet wheel, another side of said cover plate being provided with an arched hole corresponding to said second receptacle area;

a braking piece having a front arched surface provided with a teeth portion corresponding to said outer ratchet teeth of said ratchet wheel and a rear surface provided with a pair of lateral contact faces supported against said second receptacle area, a top surface of said braking piece further including a pair of blocking parts for facilitating changing directions of said braking piece, the motion of said braking piece being restricted by said arched through hole of said cover plate, said teeth portion capable of being engaged with outer ratchet teeth around said ratchet wheel by a first pushing unit;

a connecting piece disposed beneath said cover plate; a blocking piece extended from a top surface of each of said blocking parts, a flexible unit being installed between each said blocking piece and said connecting piece; and a switch piece locked with said connecting piece and being capable of being switched in a direction selected from left and right directions; and wherein there is a connecting groove between said arched hole on said cover plate and said through hole.

2. A ratchet tool, comprising:

a wrench handle forming at least a box head at one end thereof, said box head having a first and a second receptacle areas which are connected, said first receptacle area being provided with a flange and an annular groove;

a ratchet wheel engaged with said an annular groove of said box head and rotationally confined in said first receptacle area;

a cover plate connecting said wrench handle and said ratchet wheel, one side of said cover plate being provided with a through hole for passing said ratchet wheel, another side of said cover plate being provided with an arched hole corresponding to said second receptacle area;

a braking piece having a front arched surface provided with a teeth portion corresponding to said outer ratchet teeth of said ratchet wheel and a rear surface provided with a pair of lateral contact faces supported against said second receptacle area, a top surface of said braking piece further including a pair of blocking parts for facilitating changing directions of said braking piece, the motion of said braking piece being restricted by said arched through hole of said cover plate, said teeth portion capable of being engaged with outer ratchet teeth around said ratchet wheel by a first pushing unit;

a connecting piece disposed beneath said cover plate; a blocking piece extended from a top surface of each of said blocking parts, a flexible unit being installed between each said blocking piece and said connecting piece; and a switch piece locked with said connecting piece and being capable of being switched in a direction selected from left and right directions; and wherein a bottom surface of said switch piece is provided with an arched projected column capable of locking an arched slot on a top surface of said connecting piece through said arched hole on said cover plate.

3. The ratchet tool of claim 2 wherein said arched hole has a width slightly larger than said arched projected column.

4. A ratchet tool, comprising:

a wrench handle forming at least a box head at one end thereof, said box head having a first and a second receptacle areas which are connected, said first receptacle area being provided with a flange and an annular groove;

a ratchet wheel engaged with said an annular groove of said box head and rotationally confined in said first receptacle area;

a cover plate connecting said wrench handle and said ratchet wheel, one side of said cover plate being provided with a through hole for passing said ratchet wheel, another side of said cover plate being provided with an arched hole corresponding to said second receptacle area;

a braking piece having a front arched surface provided with a teeth portion corresponding to said outer ratchet teeth of said ratchet wheel and a rear surface provided with a pair of lateral contact faces supported against said second receptacle area, a top surface of said braking piece further including a pair of blocking parts for facilitating changing directions of said braking piece, the motion of said braking piece being restricted by said arched through hole of said cover plate, said teeth portion capable of being engaged with outer ratchet teeth around said ratchet wheel by a first pushing unit;

a connecting piece disposed beneath said cover plate; a blocking piece extended from a top surface of each of said blocking parts, a flexible unit being installed between each said blocking piece and said connecting piece; and a switch piece locked with said connecting piece and being capable of being switched in a direction selected from left and right directions; and further including a decorative plate corresponding to said cover plate having a through hole and an enclosed arched hole.

* * * * *